United States Patent [19]

Carroll et al.

[11] Patent Number: 4,692,980

[45] Date of Patent: Sep. 15, 1987

[54] METHOD AND APPARATUS FOR FORMING AN ARCUATE SHEET METAL SEAM

[75] Inventors: Michael W. Carroll, Roselle; Michael E. Harwood, Palatine, both of Ill.

[73] Assignee: North American Agricultural, Inc., Schaumburg, Ill.

[21] Appl. No.: 646,612

[22] Filed: Aug. 31, 1984

[51] Int. Cl.[4] ..... B21D 39/04

[52] U.S. Cl. ..... 29/243.52; 72/48; 72/18; 413/27; 413/30; 413/31

[58] Field of Search ..... 29/243.5, 243.52; 413/27, 30, 31; 72/181, 48

[56] References Cited

U.S. PATENT DOCUMENTS

| | | | |
|---|---|---|---|
| 2,264,060 | 11/1941 | Whyte | 29/243.52 |
| 2,825,384 | 3/1958 | Goldsmith | 29/243.5 |
| 4,006,520 | 2/1977 | Wachter | 29/243.52 |
| 4,406,199 | 9/1983 | Rom . | |

OTHER PUBLICATIONS

Catalog: "Lockformer Where the Machines of Tomorrow are Made Today", LC 82-15, The Lockformer Company.

Catalog: "Roll Forming Profile Ideas", Catalog 1070, revised 880, The Lockformer Company.

Catalog: "New Lockformer LC Series Roll Formers", Catalog No. 676, The Lockformer Company.

*Primary Examiner*—Nicholas P. Godici
*Assistant Examiner*—Jerry Kearns
*Attorney, Agent, or Firm*—Fitch, Even, Tabin & Flannery

[57] ABSTRACT

A method and apparatus are disclosed for fabricating an arcuate seam between two pieces of sheet metal. The method involves a three-step process in which an arcuate standing seam is formed on a first piece of sheet metal, the marginal edge of a second piece of sheet metal is inserted into the pocket of the standing seam, and the pocket of the standing seam and the marginal edge inserted therein are simultaneously bent so that they lie along the surface of the first piece of sheet metal, thus locking together the two pieces of sheet metal. The arcuate standing seam is formed by an apparatus including a plurality of form roller pairs arranged along an arc. Each pair of form rollers has complementary edges that form a nip through which the arcuate edge of the sheet metal workpiece is passed, the shapes of the edges of the successive roller pairs along the arc gradually attaining the shape of the standing seam. The workpiece is secured in a pivoting hold-down means in which the pivot point is coincident with the center of curvature of the arc described by the form rollers. After the workpiece edge passes through the form rollers, the seam formed thereon is forced through a straightener having a converging passageway that removes the waves left in the seam due to its formation. The locking seam is completed by securing the second piece to a circular drum having the same radius of curvature as the arcuate standing seam. The marginal edge of the second piece extends beyond the edge of the drum a sufficient distance to fit within the pocket of the arcuate standing seam. The first piece is then secured to end of the drum with the marginal edge portion of the second piece inserted into the pocket of the standing seam. The drum is then rotated to pass the pocket of the standing seam and the edge through a series of form rollers that simultaneously bends the pocket of the standing seam and the marginal edge of the second piece inserted therein so as to lie along the surface of the first piece, thus locking the two pieces together.

11 Claims, 24 Drawing Figures

METHOD AND APPARATUS FOR FORMING AN ARCUATE SHEET METAL SEAM

This invention relates to a method and apparatus for sheet metal fabrication and, more particularly, to such a method and apparatus that is capable of forming an arcuate locking seam on a flat piece of sheet metal.

Sheet metal ductwork is widely used in ventilation systems and often times it is desirable for ductwork to have a curved configuration, rather than a square corner, to fit around an obstacle in the path of the ductwork, or, in the case of an external vent, to provide the exposed housing or hood with a more pleasing appearance and more aerodynamic profile in order to reduce wind resistance. Such a vent for use in conjunction with a grain bin is shown and described in our copending application, Ser. No. 645,039, filed Aug. 27, 1984 now U.S. Pat. No. 4,625,630.

In practice, the fabrication of curved seams for sheet metal ductwork has typically been a labor intensive and time-consuming activity, often making the cost of such curved ductwork prohibitively expensive. Not only is it difficult to form a seam along a curve, but the completed interlocking seams frequently need to be welded or soldered to ensure their watertightness. Many of the problems confronted in the manufacture of a curved seam are due to the irregular, wavy outer edge that results when the sheet metal is folded to form a curved edge.

SUMMARY OF THE INVENTION

Accordingly it is the primary object of the present invention to provide a method and apparatus for forming a curved or arcuate locking seam on a piece of sheet metal that requires a reduced amount of labor for fabrication.

A related object is to provide such a method and apparatus that can form a substantially watertight or airtight arcuate locking seam without requiring the welding or soldering of the seam.

A further object is to provide such a method and apparatus that substantially removes the wavy edges resulting from forming a seam on an arc.

These objects and others are achieved providing by a three-step process in which an arcuate standing seam is formed on a first piece of sheet metal, the marginal edge of a second piece of sheet metal is inserted into the pocket of the standing seam, and the pocket of the standing seam and the marginal edge inserted therein are simultaneously bent so that they lie along the surface of the first piece of sheet metal, thus locking together the two pieces of sheet metal. The arcuate standing seam is formed by an apparatus including a plurality of form roller pairs arranged along an arc. Each pair of form rollers has complementary edges that form a nip through which the arcuate edge of the sheet metal workpiece is passed, the shapes of the edges of the successive roller pairs along the arc gradually attaining the shape of the standing seam. The workpiece is secured in a pivoting hold-down means in which the pivot point is coincident with the center of curvature of the arc described by the form rollers. After the workpiece edge passes through the form rollers, the seam formed thereon is forced through a straightener having a converging passageway that removes the waves left in the seam due to its formation. The locking seam is completed by securing the second piece to a circular drum having the same radius of curvature as the arcuate standing seam. The marginal edge of the second piece extends beyond the edge of the drum a sufficient distance to fit within the pocket of the arcuate standing seam. The first piece is then secured to end of the drum with the marginal edge portion of the second piece inserted into the pocket of the standing seam. The drum is then rotated to pass the pocket of the standing seam and the edge through a series of form rollers that simultaneously bends the pocket of the standing seam and the marginal edge of the second piece inserted therein so as to lie along the surface of the first piece, thus locking the two pieces together.

DETAILED DESCRIPTION

Figure 1:
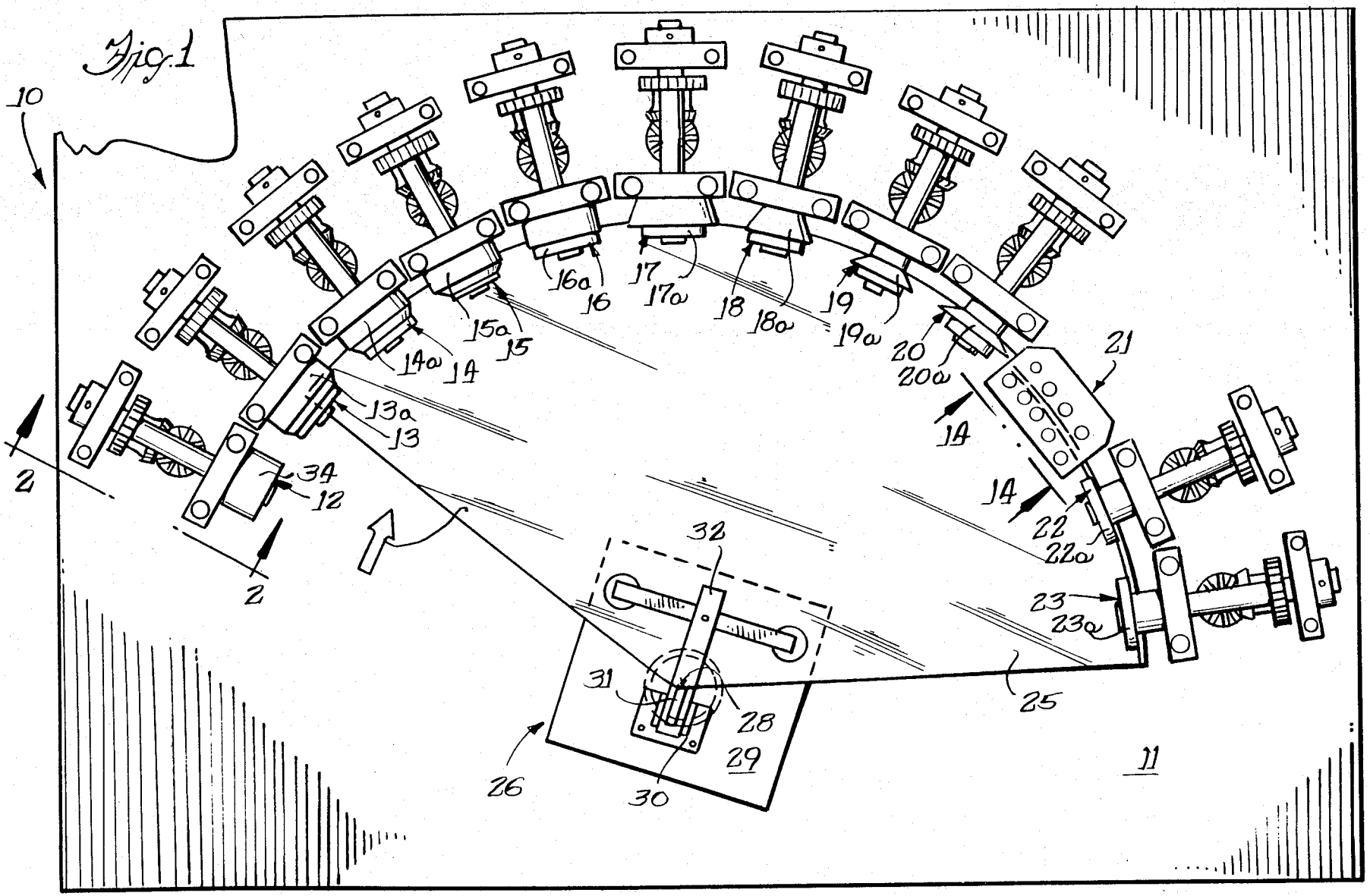
FIG. 1 is a top view of the apparatus for forming an arcuate seam that constitutes a part of the present invention.

Referring to FIG. 1 there is seen a top view of an apparatus, generally indicated by 10, for forming an arcuate standing seam. The illustrated apparatus 10 includes a plurality of rollers secured in arcuate relation along the surface of a metal work table 11, the latter being supported on the floor by legs or the like (not shown) in the well known matter. In a clockwise direction along the arc are a pair of feed rollers 12, eight pairs of form rollers 13–20, a straightener section 21, and two more pairs of feed rollers 22,23. Each of the roller pairs 12–20 and 22–23 include indentical drive means, which will be discussed in greater detail later, for simultaneously rotating both of the rollers in each pair.

To secure a sheet metal workpiece 25 in the apparatus in proper relation to the rollers, the invention includes a pivoting work holder, generally indicated by 26, the work holder 26 having its axis of rotation 28 coincident with the center of curvature of the arc formed by the rollers so that the proper relationship is kept between the edge of the workpiece 25 to formed and the form rollers. The illustrated work holder 26 is of the locking-lever type having its fixed jaw 29 in the form of a steel plate pivotally secured to the work table 12. Integral with the top of the fixed jaw plate 29 is a frame 30 holding a locking lever 31 (in the vertical position in FIG. 1) that actuates the movable jaw 32 of the work holder 26 to selectively clamp or release the workpiece 25. As can be readily appreciated, the workpiece 25 should be clamped in the work holder 26 so that the center of curvature of the seam to be formed in the workpiece 25 coincides with the axis of rotation 28 of the workholder 26.

Figure 3:
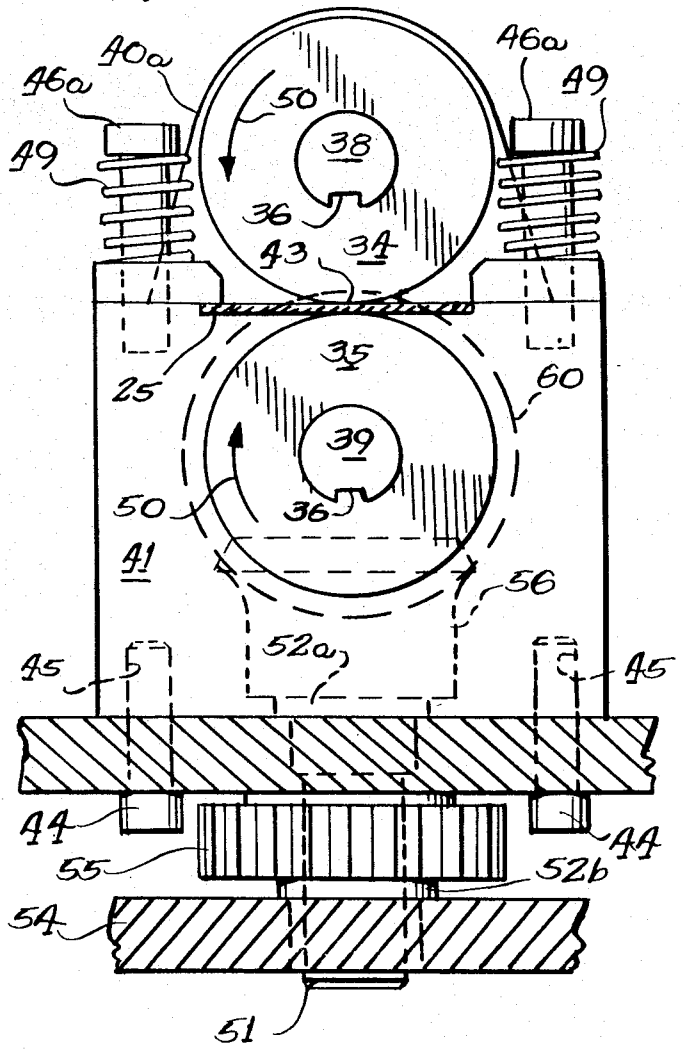
FIG. 3 is an end-view of the pair of form rollers shown in FIG. 2.
Figure 2:
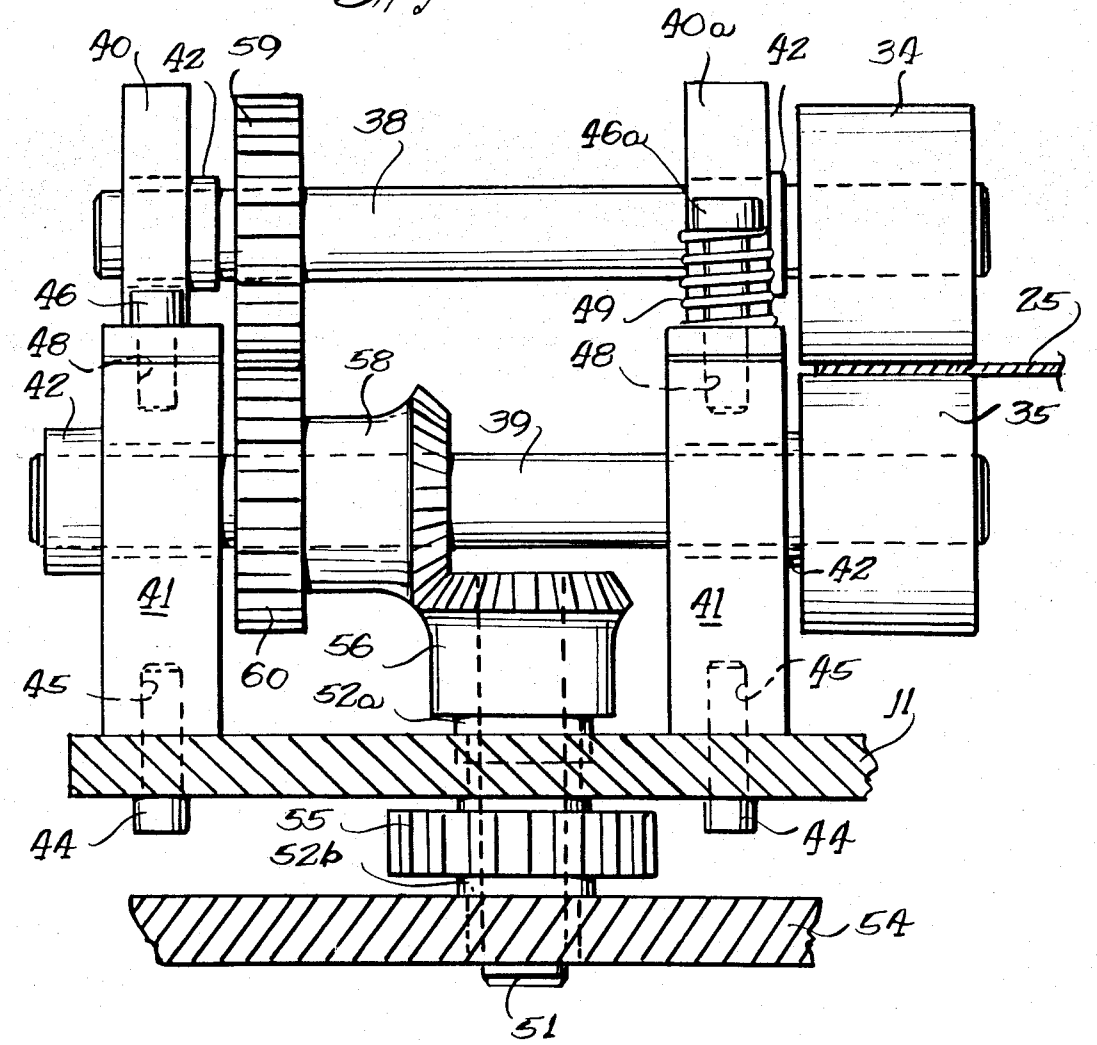
FIG. 2 is a side view of a pair of form rollers taken substantially along line 2—2 of FIG. 1.

The roller pairs 12–20 and 22–23 and the associated drive mechanism are more clearly illustrated in FIGS. 2 and 3. While FIGS. 2 and 3 particularly illustrate the feed roller pair 12, the associated driving mechanism is common to all of the roller pairs in the apparatus 10. Referring now to FIGS. 2 and 3, an upper feed roller 34 and lower feed roller 35 are secured by keyways 36 to their respective horizontal shafts 38,39. The horizontal shafts 38,39 are rotatably supported in support blocks 40,41 by bearings 42 so that the rollers 34,35 form a nip 43 through which the edge of the workpiece 25 passes. In the illustrated embodiment, the lower shaft support blocks 41 are secured to the work table 12 by bolts 44 extending through apertures in the work table and received by blind threaded holes 45 in the support blocks 41. The upper shaft support blocks 40 are, in turn, secured to the lower support block 41 by means of bolts 46 received in blind threaded holes 48 in the lower support block 41. In order to prevent damage to the rollers 34,35 and their associated support systems should the thickness of the workpiece 25 that is to be passed through the nip 43 is too great, springs 49 are interposed between the heads of the bolts **46*a* and the upper shaft support block 40*a* so that the latter and the upper roller 34 can move upward against the force of the springs 49 to accomodate the unexpectedly thick workpiece. As can be appreciated, the springs 49 must be sufficiently stiff so that as the workpiece 25 passes through the nip 43, sufficient pressure is exerted on the workpiece 25** to bend the metal to a shape which ulternately forms the seam.

In order to counter-rotate the rollers 34,35 as indicated by the arrows 50 in FIG. 3, a drive shaft 51 extending through the work table 12 is rotatably carried between bearings **52*a*, 52*b*, the lower bearing 52*b* being supported by a plate 54 secured to the bottom of the work table 11. Mounted to the drive shaft 51 intermediate the work table 11 and bearing support plate 54 is a drive gear 55. The drive gear 55 is either acted upon directly by electric motor drive means (not shown), or indirectly through the drive gears of the other roller pairs so that the electric motor drive means need be directly connected to only one drive gear 55. The upper end of the drive shaft 51 carries a bevel gear 56 that meshes with a cooperating bevel gear 58 mounted on the lower horizontal shaft 39 to rotate it and its associated roller 35 upon rotation of the drive shafts. In order to rotate the upper feed roller 34, its associated shaft 38 carries a drive gear 59 that intermeshes with a similar drive gear 60 mounted on the lower horizontal shaft 39. Accordingly, when the lower shaft 39 is rotated by means of the gears 55,56,58, the intermeshing gears 59,60 will cause the upper shaft 38** to rotate.

Figure 4:
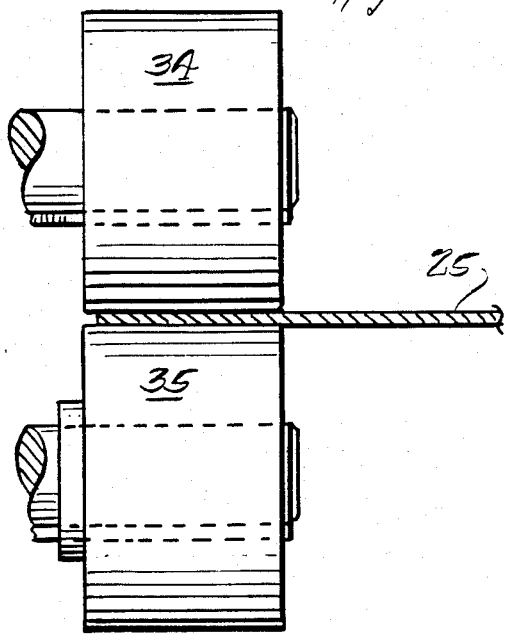
FIGS. 4–13 show the complementary edges of the successive pairs of form rollers.
Figure 5:
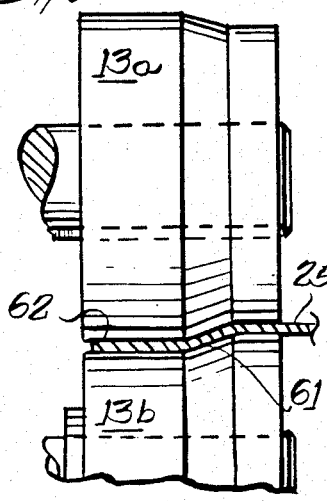
Figure 6:
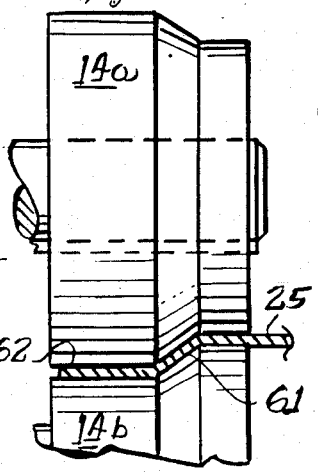
Figure 7:
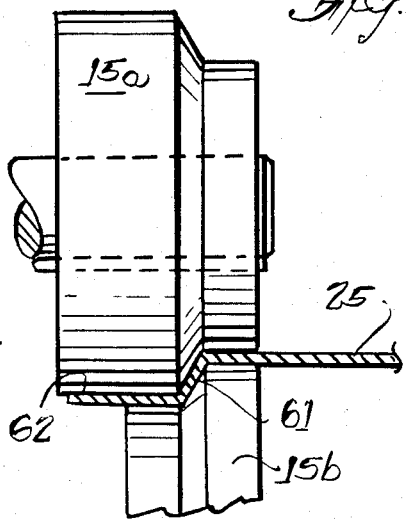
Figure 8:
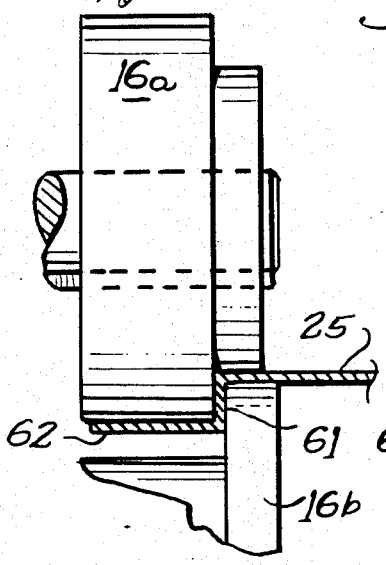
Figure 9:
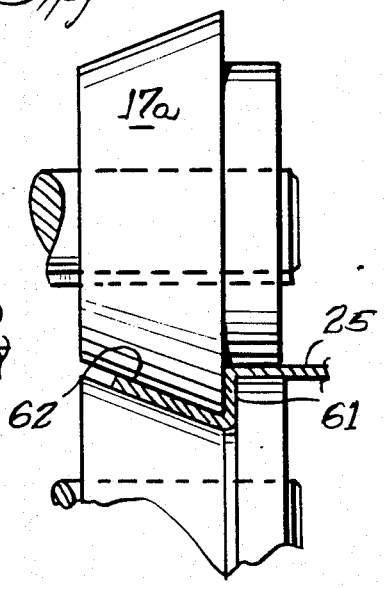
Figure 10:
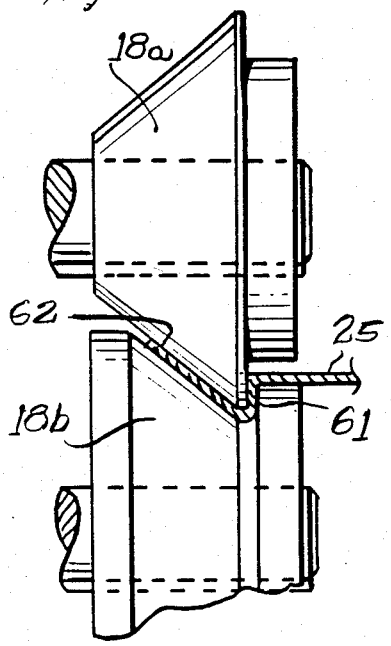
Figure 11:
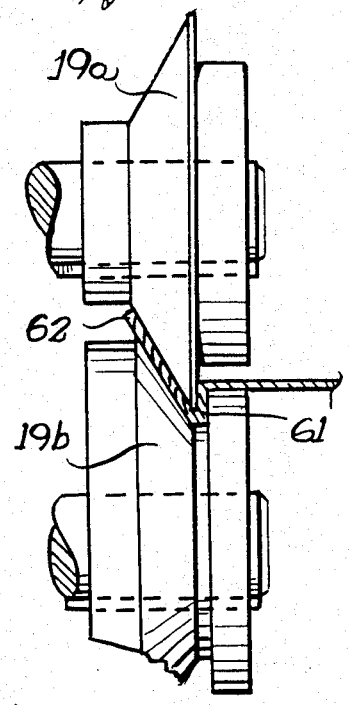
Figure 12:
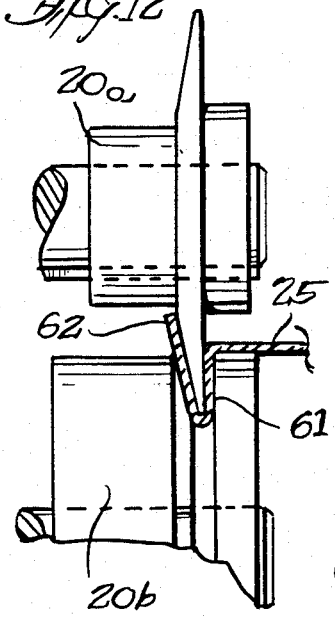
Figure 13:
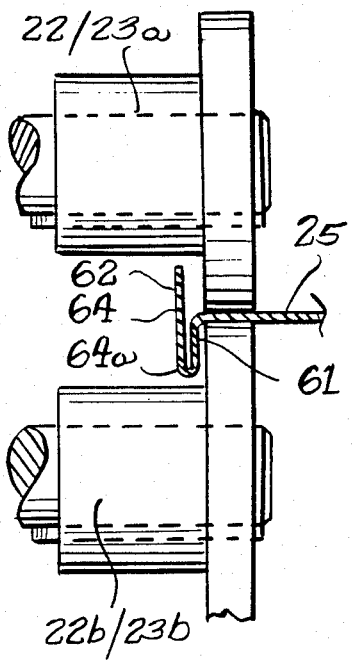

As previously noted, each of the roller pairs 12–20 and 22–23 has a support and drive system indentical to that described immediately above. However, the complementary shapes of the outer surfaces of the rollers that meet to form the nip vary depending on the function of the rollers. The mating faces of the rollers are better seen in FIGS. 4–13, with FIGS. 4–12 respectively illustrating roller pairs 12–20, and roller pairs 22–23 both being as shown in FIG. 13. Rollers 34,35 (FIG. 4) function to push the workpiece 25 through the successive form roller pairs 13–20 and the straightener section 21, while the rollers associated with the feed roller pairs 22,23 (**22*a*/23*a* and 22*b*/23*b* in FIG. 13) serve to push and pull the workpiece 25 through the same intermediate form rollers 13–20 and straightener section 21. Accordingly, the complementary faces of these rollers are flat, or, as an option, may be knurled to increase the driving friction between these rollers and the workpiece 25. As can be appreciated by sequentially viewing FIGS. 5–12, the rollers of each pair 13–20 successively act upon the edge of the workpiece 25 to form a standing seam, best seen in cross-section on the edge of the workpiece 25 in FIGS. 13 and 17**.

Figure 17:
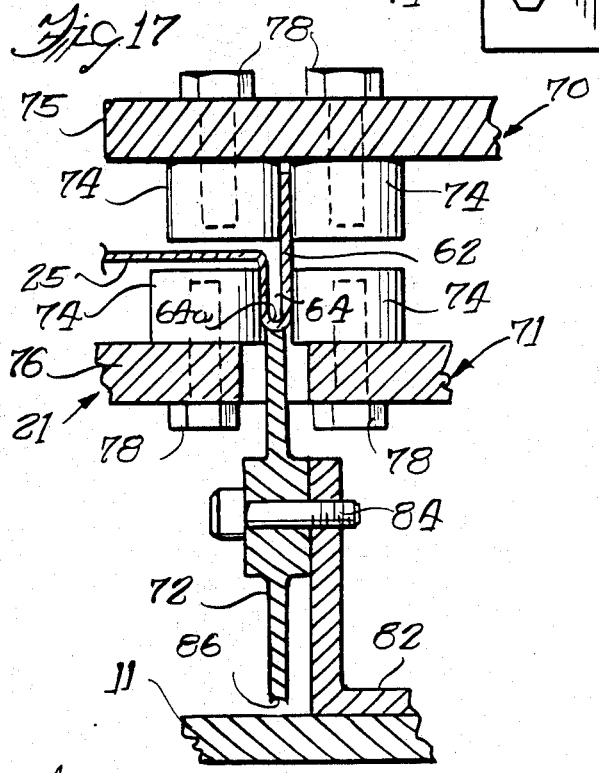
FIG. 17 is a vertical section of the straightener section taken substantially along line 17—17 of FIG. 14.

With reference to FIGS. 13 and 17 a cross-section of a standing seam comprises two legs 61,62 folded back on one another at a right angle to the workpiece 25 and forming a pocket 64. As illustrated, leg 62 is approximately twice as long as the leg 61, thus crossing the plane of the workpiece 25 so that the standing seam has a T-shaped cross-section. The legs 61 and 62 are parallel and spaced from each other by a pocket 64 which is to receive a piece of another sheet metal sheet and the legs 61 and 62 will be bent to capture the other piece, as will be explained in detail hereinafter.

The distinct steps in the formation of these legs 61,62 is seen in FIGS. 5–12. After the edge of the workpiece 25 passes through the drive rollers 34,35 (FIG. 4), from rollers **13*a*,13*b* (FIG. 5) begin forming the distinct legs 61,62 of the seam by bending the leg 16 at approximately a 15° angle with respect to both the workpiece 25 and leg 62. The form rollers 14*a*,14*b* (FIG. 6), 15*a*,15*b* (FIG. 7) and 16*a*,16*b* (FIG. 8) continue to bend the leg 61 with respect to both the workpiece 25 and the leg 62, the rollers respectively bending angles of approximately 35°, 60° and 90°. At this time, the leg 61 has been completely formed at its proper angle, herein 90°, with respect to the workpiece 25. The remaining rollers serve to bend the leg 62 to its proper position, with rollers 17*a*,17*b*, (FIG. 9), 18*a*,18*b*, (FIG. 10), 19*a*,19*b*, (FIG. 11), and 20*a*,20*b*, (FIG. 12), bending the leg 62 from its 90° angle with respect to the leg 61 to angles of approximately 70°, 50°, 30° and 10°, respectively. The seam will attain its finished shape, as seen in FIG. 13, after passing through the straightener section 21**. Manifestly, the number of form rollers may be varied from that described and the particular angles on the faces of the rollers may be varied from that described herein and still fall within the purview of the invention.

Figure 14:
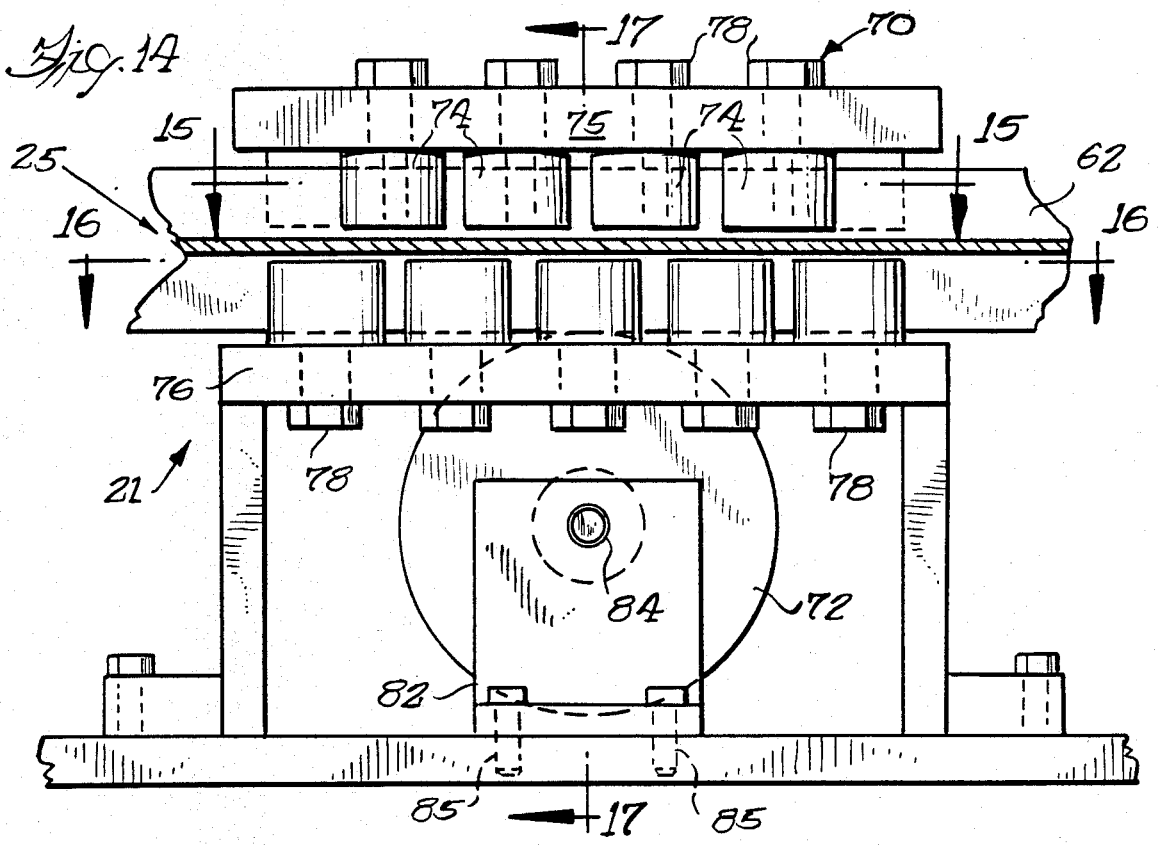
FIG. 14 is a front view of the straightener section taken substantially along line 14—14 of FIG. 1.
Figure 15:
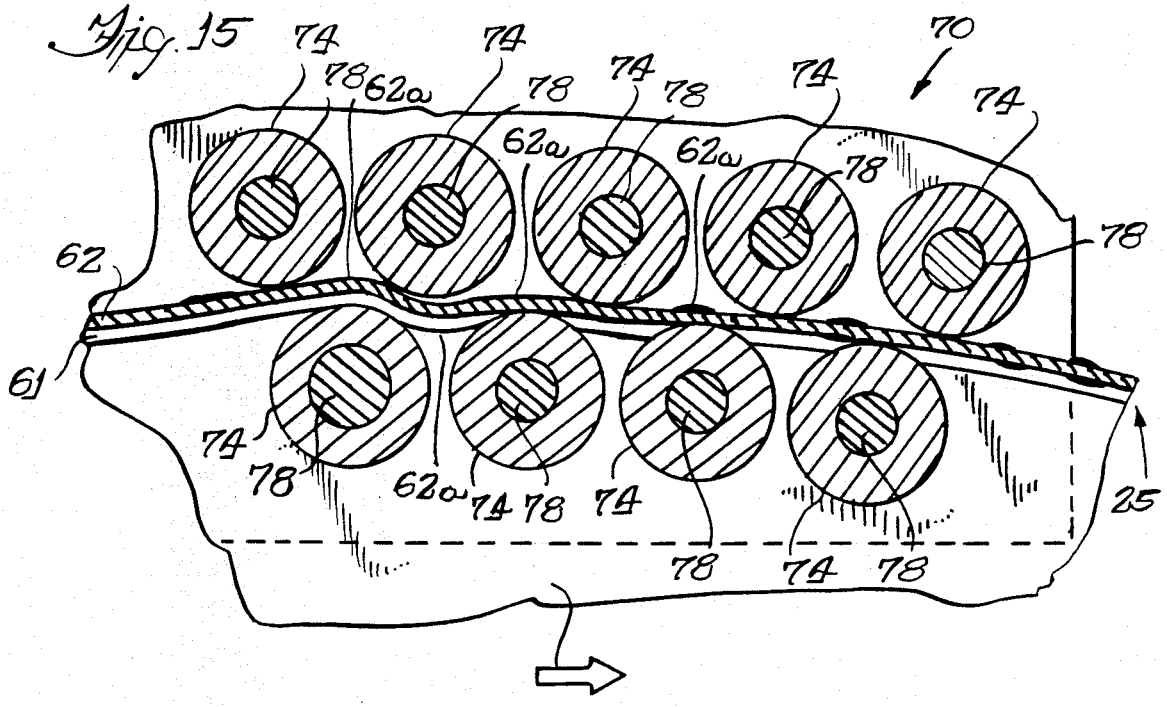
FIG. 15 is a horizontal sectional of the straightener section taken substantially along line 15—15 of FIG. 14.

When a seam is formed along an arc, waves in the outer edge of the seam will result due to the edge being folded into an arc with a smaller radius, the length of the arc of the unfolded edge being greater than the length of the arc of the folded edge. In the illustrated standing seam, such waves 62*a* are best seen in FIG. 15, appearing in the leg 62 of the seam. The formation of these waves has proved a significant problem in the formation of arcuate seams primarily because they result in a finished seam—i.e., one into which a second piece of sheet metal is secured—that is difficult to seal with or to attach to another seam piece (not shown) without welding, soldering or some other costly, labor-intensive process. Accordingly, it is a feature of the present invention to pass the wavy edges of the standing seam through a straightener section 21 that has a converging passageway that gradually reduces and substantially eliminates the waves in the arcuate seam. Referring to FIGS. 14 and 17 there can be seen the straightener section 21 having an upper forming station 70 for removing the waves in the upper-half of leg 62 of the standing seam, a lower forming station 71 for removing the waves in leg 61 and the lower-half of leg 62, and a form control roller 72 for maintaining the seam in proper position as it travels through the straightener 21.

Figure 16:
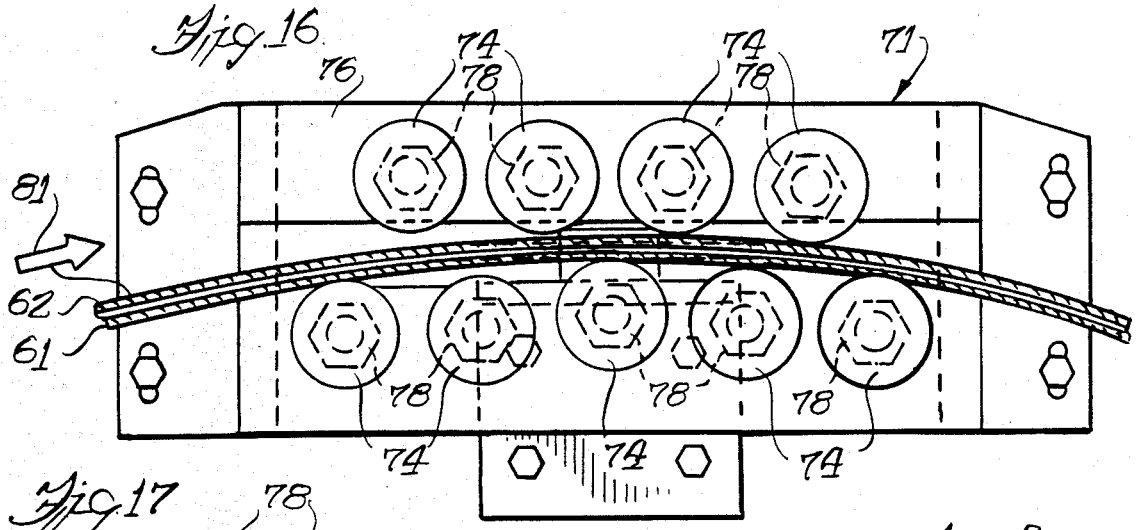
FIG. 16 is a horizontal section of the straightener section taken substantially along line 16—16 of FIG. 14.

Turning to FIGS. 14–16, both the upper forming station 70 and lower forming station 71 comprise a plurality of free wheeling rollers 74 disposed both radially inward and radially outward of the legs 61,62 of the standing seam so as to define an arcuate path though which the seam passes. The rollers 74 are rotatably mounted on support plates 75 (for the upper forming station) and 76 (for the lower forming station) by stub-shafts 78, with the support plates 75,76 being carried by legs 79 secured to the work table 11 by bolts 80. As best seen in FIGS. 15 and 16, travelling left-to-right in the direction of arrow 81, the same direction that the workpiece 25 passes through the straightener 21, the distance between the facing surfaces of the rollers 74 oppositely disposed pairs of rollers on opposite sides of the legs 61,62 of the seam decreases so that the final two oppositely disposed rollers permit travel through the straightener by either only the single leg 62 (for upper forming station 70 shown in FIG. 15) or the two legs 61,62 and the pocket 64 defined thereby (for lower forming station 71 shown in FIG. 16). Herein, the axes of the upper outer set of rollers 74 are mounted on and define a common arc and the axes of the lower and inner rollers 74 are mounted and define a second arc. The respective arcs converge from the left to right in FIG. 15. These converging passageways formed by the rollers 74 on opposite sides of the seam function to gradually reduce the more prominent bends or waves 62*a* in the seam that result from the formation of the seam and also serve to pinch the pocket 64 of the standing seam so that the seam attains its final shape. In order to prevent the workpiece 25 from traveling downwardly as it passes through the straightener 21, the form control roller 72 is provided to rollingly engage the lower end of the pocket 64 of the seam. Referring to FIG. 17, the form control roller 72 is mounted for rotation to an L-shaped bracket 82 by means of bolt 84. The bracket 82 is, in turn, secured to the work table 11 by bolts 85 (FIG. 14). As best seen in FIG. 17, the outer edge 86 of the form control roller 72 is concave so as to better cradle a bend 64*a* in the seam as it passes through the straightener 21.

After the arcuate standing seam is formed on the edge of the workpiece 25, it is ready to be lockingly joined to another piece of sheet metal to complete the seam. In order to manufacture the vent housing having a V-shaped cross-section as described in our above-referenced copending application, another workpiece having a standing seam similar to the workpiece 25 previously described is required for the second side member, and a third piece of sheet metal is required for the top member of the housing. Generally, the pieces are joined by securing the top member to a drum so that the edges of the top member extend beyond the edge of the drum. The pockets in the standing seams of the side members are slipped over the edges of the top member, the side members being held in place by friction. Then the drum is rotated so that the pockets of the standing seams and the edges of the top member held therein are worked on by a series of forming rollers to fold the pockets flat against the face of the side members, thus locking the seams. While the apparatus to be described hereafter is designed to simultaneously join together the two side members and top member of a vent housing in accordance with our above-referenced application, thus requiring the locking of two seams, the method and apparatus will be described with respect to the locking of only one seam, the other seam being locked simultaneously.

The preferred locking system and method of forming a vent hood requires only the formation of only two arcuate workpieces 25 each with an arcuate seam and the third top piece may be a flat sheet requiring no bending or seaming operation thereon prior to assembly with the two arcuate side workpieces 25.

Figure 18:
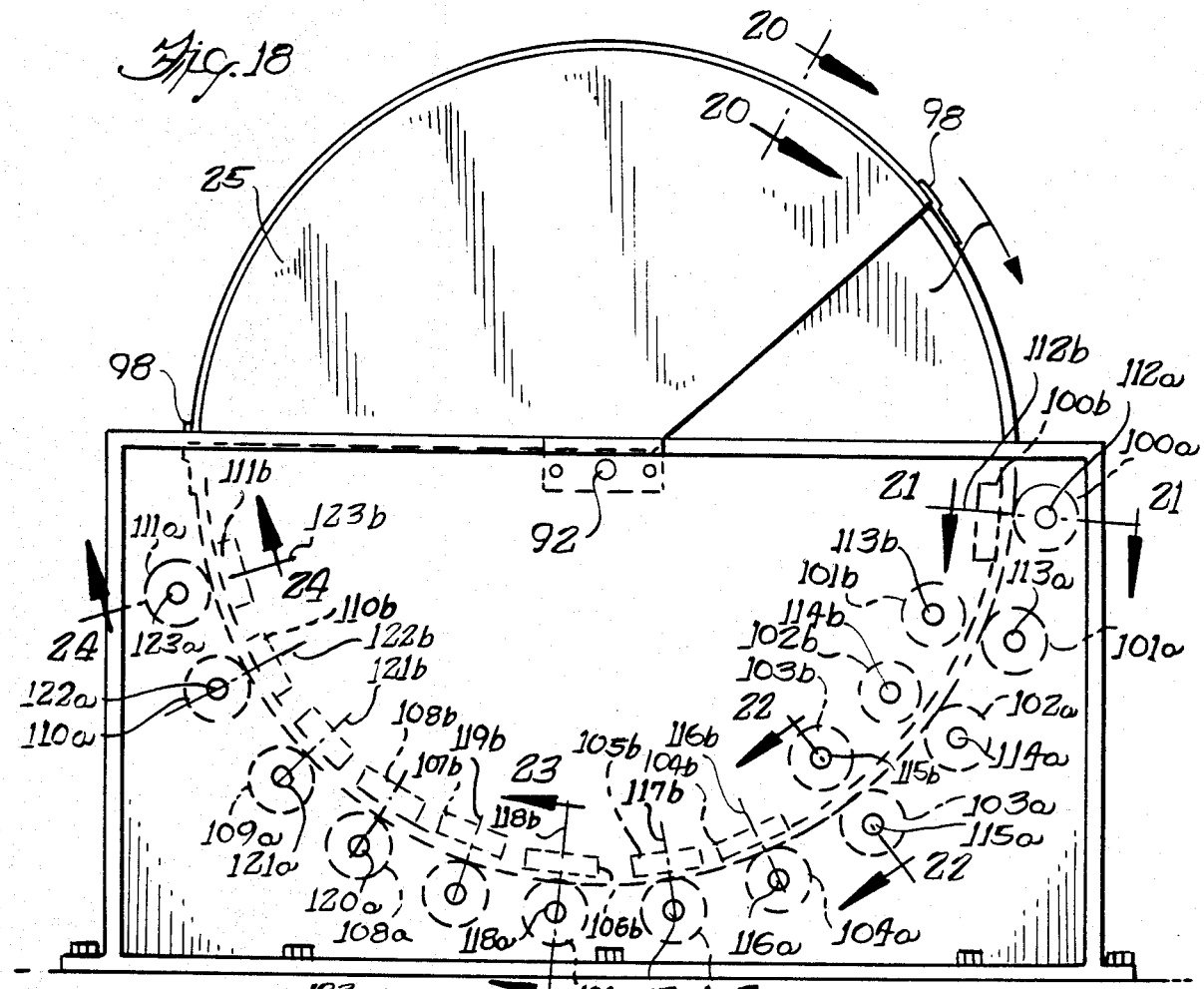
FIG. 18 is a side view of an apparatus constituting a part of the present invention for forming a locking seam between two pieces of sheet metal, one of which has an arcuate seam.
Figure 19:
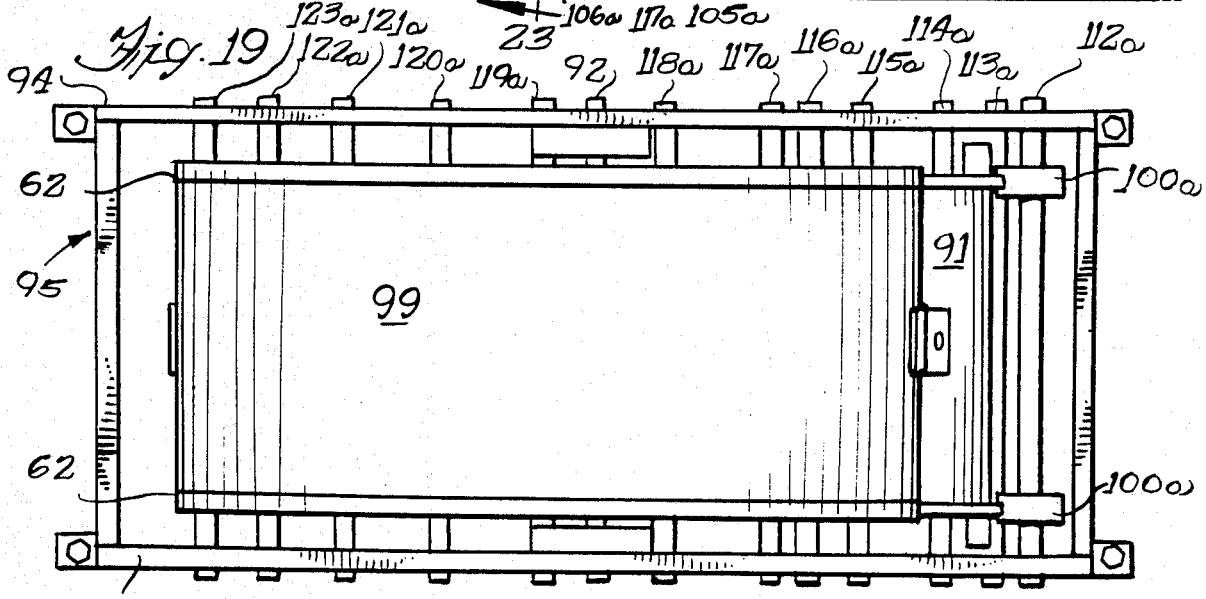
FIG. 19 is a top view of the apparatus shown in FIG. 18.
Figure 20:
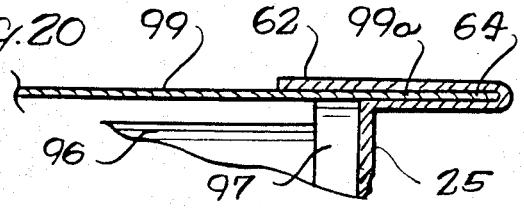
FIG. 20 is a fragmentary cross-sectional view taken substantially along line 20—20 in FIG. 18 showing drum of the apparatus and its associated workpieces.
Figure 21:
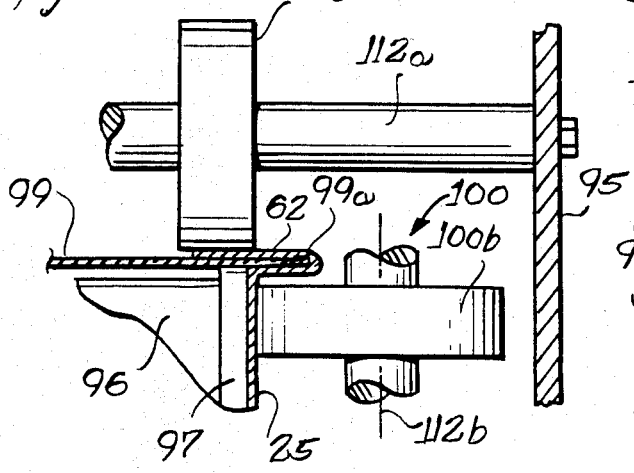
FIG. 21 is a fragmentary cross-sectional view taken substantially along line 21—21 of FIG. 18 showing a guide station.

Turning now to FIGS. 18 and 19, there is seen an apparatus, generally indicated by 90, for forming two locking seams simultaneously to join three pieces of sheet metal. The apparatus 90 includes a drum 91 having approximately the same radius as the arcuate seam in the workpiece 25. The drum 91 is mounted on an axle 92 journaled for rotation in the side plates 94 of the drum housing, generally indicated by 95. The drum 91 and its associated housing 95 are mounted on a work table (not shown) and the drum 91 is powered for rotation by electric motor drive means (also not shown) associated with axle 92. As best seen in FIGS. 20–24, the drum 91 comprises a rolled cylinder 96 having its open ends closed by a circular steel plate 97. Two clamps 98 (FIGS. 18,19) are provided on the cylinder 96 for securing the second piece of sheet metal or workpiece 99 that is to be joined to the workpiece 25. The workpiece 99 is secured to the drum 91 so that its marginal edge 99*a* (FIG. 20) extends past the drum end plate 97 a distance approximately equal to the depth of the pocket 64 of the standing seam in the side number 25. The pocket 64 of the side member 25 is then forced over the marginal edge portion 99*a* of the workpiece 99 so that the configuration shown in FIG. 20 is attained, with the side member 25 lying flush along the end plate 97 of the drum 91.

In practice, the two arcuate workpieces 25 are laid along the opposite vertical sides of the drum 91 and the workpiece 99 is then laid on the top circular portion of the drum cylinder 96. One of the clamps 98 is locked to hold the top workpiece 99 in place. The operator then merely operates a control switch to cause one revolution of the drum 91 to form both side seams automatically.

Mounted interior of the housing 95 adjacent the edges of the drum 91 is a series of twelve pairs of free-wheeling guide/form rollers 100–111 (FIGS. 21–24). The outer roller 100*a*–111*a* in each pair—i.e., the one furtherest from the axle 92—is mounted for rotation on a stationary shaft 112*a*–123*a* that extends across the housing 95 between the side plates 94, so that each shaft carries a roller adjacent each side plate, as illustrated in FIG. 19 with shaft 112*a* carrying two rollers 100*a*. The other roller 100*b*–111*b* in each pair is mounted for rotation on axles, the axes of which are generally indicated by 112*b*–123*b*, the shafts being supported on the housing side plates 94.

Figure 22:
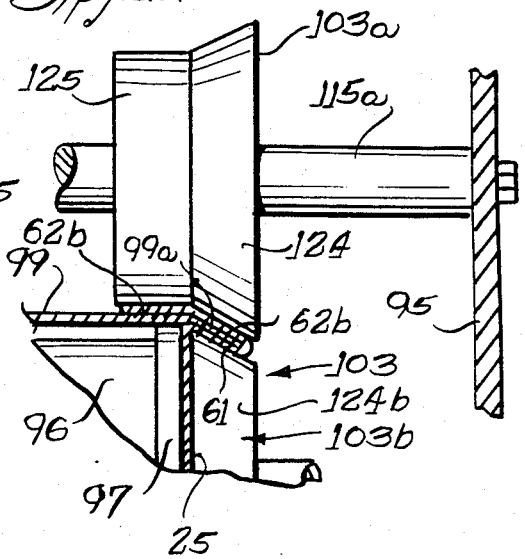
FIG. 22 is a fragmentary cross-sectional view taken substantially along line 22—22 of FIG. 18 showing a forming station.
Figure 23:
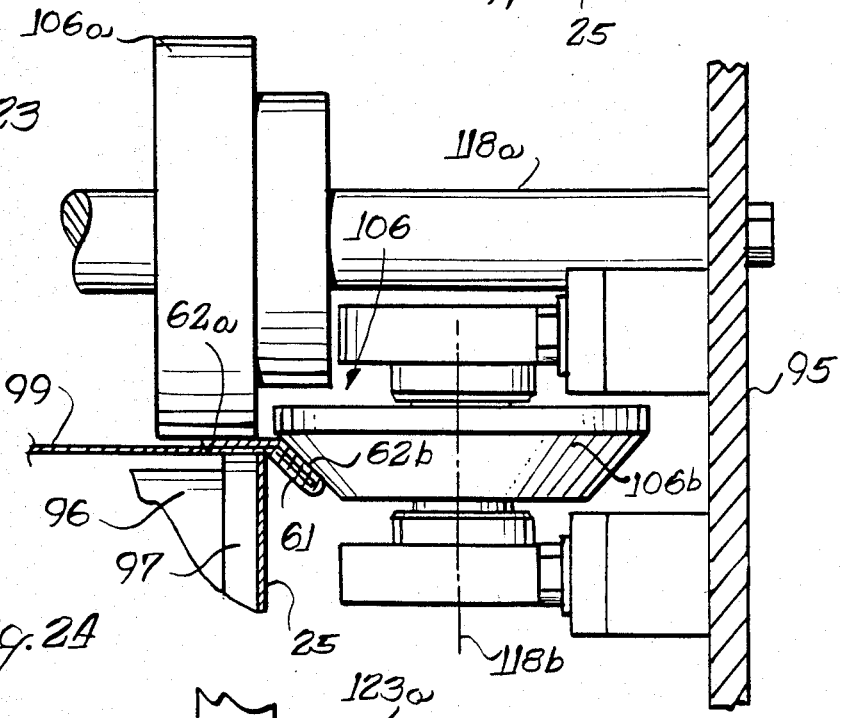
FIG. 23 is a fragmentary cross-sectional view taken substantially along line 23—23 of FIG. 18 showing another forming station.
Figure 24:
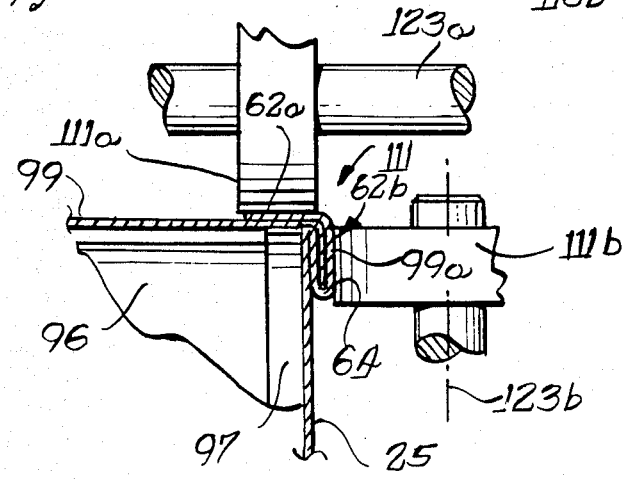
FIG. 24 is a fragmentary cross-sectional view taken substantially along line 24—24 of FIG. 18 showing another guide station.

Typical roller pairs are seen in greater detail in FIGS. 21–24, which show roller pairs 100, 103, 106 and 111, respectfully. Rollers 100*a*, 100*b* are pinch rollers that engage the leg 62 of the seam and the workpiece 25 so as to hold and properly position the workpieces 25, 99, and 25 for their engagement with the subsequent form rollers. The rollers in pairs 101–103 engage both legs 61 and 62 of the pocket and begin to bend these legs and the pocket in workpiece 25 and the marginal edge portion 99 of the workpiece 99 toward a 45° angle with respect to the workpiece 25, as typified by rollers 103*a*, 103*b* (FIG. 22). In addition to the angled portion 124 of roller 103*a* that matches the angled portion 124*b* of roller 103*b*, the roller 103*a* includes a straight cylindrical portion 125 that continues to pinch the free end 62*a* of the leg 62 against the drum 91, thus maintaining it in non-slip contact with the workpiece 99 and the drum. Otherwise, the free end 62*a* of the leg 62 would move away from the workpiece 99 as leg portion 62*b* and leg 61 of the pocket are bent. The edge portion 99*a* in the pocket 64 is bent to the same degree as the leg portion 62*b* and leg 61 engaging the respective rollers 103*a* and 103*b*. The remaining "a" rollers in each succeeding roller pair 104–111 have no bending function, but perform as pinch rollers to hold the free end of leg 62 tight against the workpiece 99 and the drum end plate 97 while the pocket legs 62*b* and 61 of the standing seam and the marginal edge portion 99*a* of the workpiece 99 are bent. Rollers 104*b* through 111*b* engage leg portion 62*b* of the pocket 64 and bend it and leg 61 to complete the bending of the seam. The completed seam appears as shown in FIG. 24, with the side member 25 having an S-shaped fold along its marginal edge portion, the S-fold having an upward opening pocket that receives the downward extending edge 99*a* of the top piece 99, and the terminal edge 62*a* of the S-fold being at a right angle with respect to the side member so as to be along the top member. Because of the interlocking nature of this seam, it presents a substantially air and water tight seam that requires no additional welding or soldering. Because the outer free edge 62*a* of the seam is held tightly against the drum end plate 97 at a series of locations simultaneously, the edge portions 99*a* of the top sheet 99 are also held against shifting. The bending is done against rollers such as 103*b* to carefully hold the seam legs in position at the bend until the bend is about 45° as shown in FIG. 23. After this, the only bending that will occur is toward the flat vertical end workpiece 25 so that the inner side of the seam need not be held by a form roller. The last roller 111*b* flattens and finally forms the seam. From the foregoing, it will be seen that an arcuate pocket seam may be formed automatically in an arcuate edge of a first sheet and then an unbent edge of a second sheet may be insert into the arcuate pocket and that the pocket and insert edge portion may be automatically bent through about 90° to lock the edges into a permanent seam. When making a three piece vent hood, a pair of arcuate pocket seams may be provided on opposite sides of a common top sheet with opposite edge portions inserted into the pockets and a completed seam formed automatically at both arcuate edges of the vent hood.

The formation of the arcuate seams may be accomplished with unskilled labor without having to employ a skilled metalworker. Also, the seams are formed more quickly than can be done manually. Thus, the seamed product is made cheaper than can be done manually. Also, some seams require that both pieces being joined be bent along their edges before being joined together. Herein, the top piece is not bent but merely has a straight edge portion slipped into a pocket. Thus, the number of pieces to be bent may be reduced with this invention to provide additional savings.

Thus, it can be seen that a method and apparatus have been provided which fully meets the above-stated objects. While the invention has been described in terms of a preferred embodiment, it is not intended to limit the invention to the same, but to include all equivalents and modifications within the scope of the accompanying claims.

What is claimed:

1. An apparatus for forming an arcuate folded edge seam on an arcuate edge of flat workpiece of sheet metal comprising, in combination, a machine frame, a work holder on said machine frame mounted for turning movement relative to said machine frame, a plurality of form roller pairs mounted in said frame and arranged along an arc and about a predetermined axis, the rollers of each pair having mating surfaces that form a nip, the shape of the nips on the successive form roller pairs along the arc being such as to gradually bend the arcuate edge of the flat sheet metal piece to form the arcuate edge seam as the arcuate edge of the workpiece passes through the roller pairs; the length of the arc of the arcuate edge being greater than the length of arcuate folded edge seam and the excess in length causing waves in the seam, straightener means mounted in said frame adjacent said rollers comprising a converging passageway positioned on the arc of the form roller pairs for smoothing the waves in the arcuate seam formed in the workpiece; means mounted on said frame for feeding the workpiece through the form roller pairs and the straightener means; work hold down means for holding the workpiece on said work holder; and drive means mounted on said frame and connected to said means for feeding and effecting relative rotational movement of the workpiece relative to the former rollers and straightener means about said predetermined axis at the center of curvature of the arc defined by the form roller pairs and straightener means.

2. The combination of claim 1 wherein the straightener means further comprises a plurality of free-wheeling rollers arranged so that the outer edges of adjacent rollers define the converging passageway to reduce the waves in the arcuate folded edge seam.

3. The combination of claim 1 wherein the workpiece feeding means comprises at least one pair of drive rollers, the drive rollers having a knurled surface, and means for rotating the drive rollers and the form roller pairs.

4. The method of forming an arcuate folded edge seam in an arcuate edge of a flat sheet metal workpiece, the steps comprising, securing the workpiece in a work holder; rotating the workpiece relative to form rollers and about a predetermined axis of rotation; passing the arcuate edge of the workpiece through the nips of a plurality of form roller pairs so as to bend the arcuate edge of the flat workpiece into a standing seam having an arcuate folded length less than the length of the arcuate edge of the metal sheet thereby forming waves in the standing seam, the form roller pairs being arranged on an arc that coincides with said predetermined axis, and reducing any waves in the workpiece standing seam resulting from the forming of the standing seam by passing the seam through a converging arcuate passageway and engaging the waves on opposites thereof and forcing waved metal into the arcuate shape of the standing seam.

5. The method of forming an arcuate locking seam to join together two pieces of sheet metal, one piece of sheet metal having a straight marginal edge and the second piece of flat sheet metal having an arcuate standing seam formed thereon with first and second legs forming a pocket therebetween, the steps comprising, securing the first piece of sheet metal to a curved surface of a rotatable drum so that the edge of the sheet metal extends beyond the edge of the drum; positioning the second piece of sheet metal on a radial end surface of the drum and positioning the pocket of the standing seam over the extending edge of the first piece of sheet metal; and rotating the drum relative to a plurality of form rollers so that the pocket of the standing seam is successively engaged by the plurality of form rollers that simultaneously bend the pocket of the standing seam and the extending edge of the first piece of sheet metal toward one of said drum surfaces, said rollers rolling along the face of the second piece of sheet metal, and bending together the edges of the respective sheets and locking together the two pieces of sheet metal at a predetermined angular relationship to each other.

6. An apparatus for joining together two pieces of sheet metal along an arc, wherein the first piece of sheet metal has an arcuate standing seam along the edge thereof and the second flat piece of sheet metal has a substantially straight arcuate edge, the combination, comprising, a machine frame means, a drum mounted on said machine frame means for carrying the second piece of sheet metal thereon, the drum being journaled for rotation and having means for securing the second workpiece to a cylindrically extending surface of the drum with the arcuate edge of the second workpiece extending beyond the edge of the drum, a radially extending face on the drum having means for holding the first sheet for rotation with the arcuate edge of second sheet received in the pocket of the standing seam of the first piece of sheet metal; form roller means mounted on said machine frame means and disposed adjacent the periphery of the drum for engaging and bending the pocket in the arcuate standing seam of the first piece of sheet metal and the edge of the second piece of sheet metal contained therein upon rotation of the drum; and means for rotating the drum mounted on said machine frame means.

7. A method making a vent hood having a pair of sector-shaped flat sidewalls and an arcuate top wall joined to the sidewalls at arcuate corners having arcuate locking seams between the sidewalls and the top wall with a rotatable drum having form rollers adjacent each wall on the drum, said method comprising the steps of:

forming automatically by form rollers an arcuate seam having parallel legs defining an open pocket therebetween along arcuate edges of each of the sidewalls, assembling two sidewalls with their open arcuate pockets facing each other on the end walls of the drum and inserting into the open arcuate pockets opposite parallel edges of the arcuate top wall while holding the top wall in a curved shape on a curved surface on the drum with arcuate edges thereon, and bending automatically by form rollers the assembled edges and parallel walls defining the pocket to lock together the inserted edges and parallel legs to form the arcuate locked seams and to complete the joining of the curved top wall to the sector shaped flat sidewalls at the locked seams.

8. A method in accordance with claim 7 in which the top wall is a flat rectangular strip of metal including the further steps of bending the strip of metal into an arcuate shape manually while manually inserting edges of the opposite long sides of the strip into the open pockets of the respective sidewalls.

9. A method in accordance with claim 8 in which the form rollers to bend the pockets and the inserted edges of the strip are mounted in arcuate path about the periphery of a rotatable drum rotatable about a horizontal axis and in which the assembling step includes the further steps of laying the sidewalls along the radially extending sides of the drum with the arcuate open seams adjacent the top of the drum and facing each other, and securing the strip of metal to the circumferential wall of the drum, and driving the drum to move the assemblage past the form rollers.

10. An apparatus for making a vent hood having a pair of flat sector-shaped sidewalls and an arcuate top wall joined to the sidewalls at arcuate corners having locking seams between the sidewalls and the top wall, said apparatus comprising:

a frame means, forming means having form rollers mounted on said frame means for bending an arcuate edge of the sidewall to form an arcuate seam having parallel legs defining an open pocket therebetween along arcuate edges of each of the sidewalls, and drum means on said frame means having radially extending end walls having means for holding two sidewalls with their open pockets facing each other and having a circumferential wall between the end walls for holding the top plate with its opposite edges inserted into the open pockets opposite parallel edges of a top wall while holding the top wall in a curved shape, and form rollers on said machine frame for bending the assembled edges and parallel walls defining the pocket to lock together the inserted edge and parallel legs to form the arcuate locked seams and to complete joined of the curved top wall to the sidewalls at the locked seams.

11. An apparatus in accordance with claim 10 in which the form rollers for bending the pockets and the inserted edges of the strip are mounted in arcuate path about the periphery of the drum means, the latter being rotatable about a horizontal axis, radially extending side of said drum being positioned against said sidewalls with their arcuate open seams adjacent the top of the drum and facing each other, and means for securing the strip of metal to the circumferential wall of the drum while being past the form rollers.

* * * * *